United States Patent [19]

Ikegami et al.

[11] Patent Number: 5,013,963

[45] Date of Patent: May 7, 1991

[54] IN-LINE TYPE ELECTRON GUN

[75] Inventors: Kazunori Ikegami; Souitirou Okuda, both of Amagasaki; Eishou Nosaka; Tadahisa Yoshida, both of Nagaoka, all of Japan

[73] Assignee: Mitsubishi Denki Kabushiki Kaisha, Tokyo, Japan

[21] Appl. No.: 907,823

[22] Filed: Sep. 16, 1986

[30] Foreign Application Priority Data

Sep. 20, 1985 [JP] Japan ..... 60-209422
Sep. 20, 1985 [JP] Japan ..... 60-209423

[51] Int. Cl.[5] ..... H01J 29/51

[52] U.S. Cl. ..... 313/414; 313/409; 313/412; 313/460

[58] Field of Search ..... 313/414, 409, 412, 413, 313/458, 460, 449

[56] References Cited

U.S. PATENT DOCUMENTS

| | | | |
|---|---|---|---|
| 4,234,814 | 11/1980 | Chen et al. | 313/414 |
| 4,370,592 | 1/1983 | Hughes et al. | 313/414 |
| 4,388,552 | 6/1983 | Greninger | 313/414 |
| 4,400,649 | 8/1983 | Chen | 313/414 |
| 4,558,253 | 12/1985 | Bechis et al. | 313/414 |
| 4,583,024 | 4/1986 | Chen | 313/414 |
| 4,590,402 | 5/1986 | Alig | 313/414 |
| 4,620,133 | 10/1986 | Morrell et al. | 313/414 X |

OTHER PUBLICATIONS

An Overview of the COTY-29 Tube System: An Improved Generation of Color Picture Tubes, IEEE Transaction on Consumer Elec., CE-28, 290-296 (Aug. 1982).

*Primary Examiner*—Donald J. Yusko
*Assistant Examiner*—Michael Horabik
*Attorney, Agent, or Firm*—Burns, Doane, Swecker & Mathis

[57] ABSTRACT

The in-line type electron gun of this invention is formed so that a depression, which is formed at the lower voltage electrode face opposing to the higher electrode of the two electrodes for forming a common main focusing lens in the opposing gap thereof and has three lens holes for individual electron beams arrayed in-line at the bottom thereof, is formed so that the width in the direction perpendicular to the lens hole array direction is smaller at the central part in the lens hole array direction as compared with the other parts. Also the center lens hole of the three lens holes at the bottom of the depression is smaller in diameter than the other two. Accordingly, the focus voltages of the three beams passing through the three lens holes and the shapes of beam spots are made more uniform as compared with the prior art.

3 Claims, 5 Drawing Sheets

IN-LINE TYPE ELECTRON GUN

BACKGROUND OF THE INVENTION

1. Field of the Invention

This invention relates to an in-line type electron gun used in a high resolution color cathode ray tube, and more particularly to an in-line type electron gun enhanced in performance by unifying the focus voltage and beam spot shape of three electron beams.

2. Description of the Prior Art

FIG. 1 shows the structure of a conventional in-line type electron gun, in its side section (a) and front section (b) by line A–B.

In the figure, numeral 1 is a cathode, 2 is a number 1 grid (G1 grid) disposd before the cathode 1, 3 is a number 2 grid (G2 grid) disposed before the G1 grid 2, 4 is a number 3 grid (G3 grid) disposed before the G2 grid 3, and 5 is a number 4 grid (G4 grid) disposed before the G3 grid 4.

A triode is composed of G1 grid 2 and G2 grid 3. A main focusing lens is formed by G3 grid 4 and G4 grid 5 between them (the position of line A–B in the drawing), in which the G3 grid 4 is the lower voltage side grid. Numeral 6 is a beed glass for fixing the grids 2, 3, 4, 5. Numeral 7 is a depression provided in the front face of the G3 grid 4, more specifically, in the face facing the opposing gap to the G4 grid 5. As a voltage is applied between G3 grid 4 and G4 grid 5, a magnetic field is generated, and the main focusing lens common to three electron beams is formed in the depression 7. At the bottom of the depression 7, there are three lens holes 71, 72, 73 of identical diameter provided in-line so as to form small lenses for individual electron beams corresponding to the red, green and blue colors.

By disposing the depression 7 in front of confronting side of the G3 grid 4 and G4 grid 5, the structure to form a common main focusing lens in the position of the depression 7 aside from the small lenses for individual electron beams formed in the lens holes 71 to 73 is disclosed by A. M. Morrel as "An Overview of the COTY-29 Tube System: An Improved Generation of Color Tubes" in IEEE Transaction on Consumer, Vol. CE-28, No. 3, August 1982.

In this in-line type electron gun, the electron beam gaps may be narrowed with almost no influence to the focus characteristics.

In this disclosure, meanwhile, the depression 7 is oval, more specifically, formed in a form of a race track oblong in the direction of lens hole array, and the diameters of three lens holes 71 to 73 are all identical.

In such conventional in-line type electron gun, the thermion generated by the cathode 1 is pulled out and accelerated by voltage applied to the G1 grid 2 and G2 grid 3 which make up a triode. And the electron field caused by the difference in voltage applied to the G3 grid 4 and G4 grid 5 (as mentioned above, the voltage is lower at the G3 grid 4 side) will form a main focusing lens in the depression 7, which causes to warp the orbit of the electron, so that the three electron beams are converged to be concentrated on one point at the position before the G4 grid 5.

In this in-line type electron gun, the three lens holes (beam passing holes) 71 to 73 provided at the bottom of the depression 7 in front of the G3 grid 4 in which the main focusing lens is formed are made in identical diameter. Therefore, by the three-dimensional effect of the electric field, the focus voltage differs between the two outer lens holes 71, 73 and the center hole 72. As a result, the shapes of spots of the beam from the center lens hole 72, and of the beams from the two outer lens holes 71, 73 (that is, the shadow projected on the intersecting plane of the beam running directions) are different, and sharpness of the picture is lowered.

SUMMARY OF THE INVENTION

This invention is intended to solve the above-discussed problems.

It is hence a primary object of this invention to present an in-line type electron gun forming a common main focusing lens by providing a depression in the front face of the G3 grid, aside from the individual lenses for three electron beams, wherein the focus voltages applied to three beams may be satisfactorily uniformed by forming the middle lens holes of the three lens holes in a smaller diameter than the two outer lens holes.

It is a second object of this invention to present an in-line type electron gun forming a common main focusing lens by providing a depression in the front face of the G3 grid, aside from the individual lenses for three electron beams, wherein the beam spot shapes of three beams may be satisfactorily uniformed by forming the middle lens hole of the three lens holes in a smaller diameter than the two outer lens holes.

It is a third object of this invention to present an in-line type electron gun capable of achieving the above objects more securely by designing the depression in the front face of the G3 grid for forming the common main focusing lens so that the width in the perpendicular direction to the array direction of each lens hole may be narrower in the middle lens hole part than other portions.

The in-line type electron gun of this invention can correct the lowering of focusing power in the lens hole array direction with respect to the electron beam in the middle lens hole by designing the middle lens hole of the three lens holes in a smaller diameter than the other two. Moreover, the in-line type electron gun of this invention can increase the focusing power in the perpendicular direction to the lens hole array direction with respect to the electron beam in the middle lens hole, by narrowing the width in the perpendicular direction to the lens hole arrary direction in the depression where three lens holes are arranged in the front face of the G3 grid, in the middle portion.

The above and further objects and features of the invention will more fully be apparent from the following detailed description with accompanying drawings.

BRIEF DESCRIPTION OF THE DRAWINGS

FIG. 1 (*b*) is a front section showing the structure of the conventional in-line type electron gun;

FIG. 2 (*b*) is a front section showing the structure of the in-line type electron gun of the first invention;

FIG. 5 (*b*) is a front section showing the structure of an in-line type electron gun of the second invention.

DESCRIPTION OF THE PREFERRED EMBODIMENTS

The in-line type electron gun of this invention is described below with referring to the accompanying drawings.

Figure 1A:
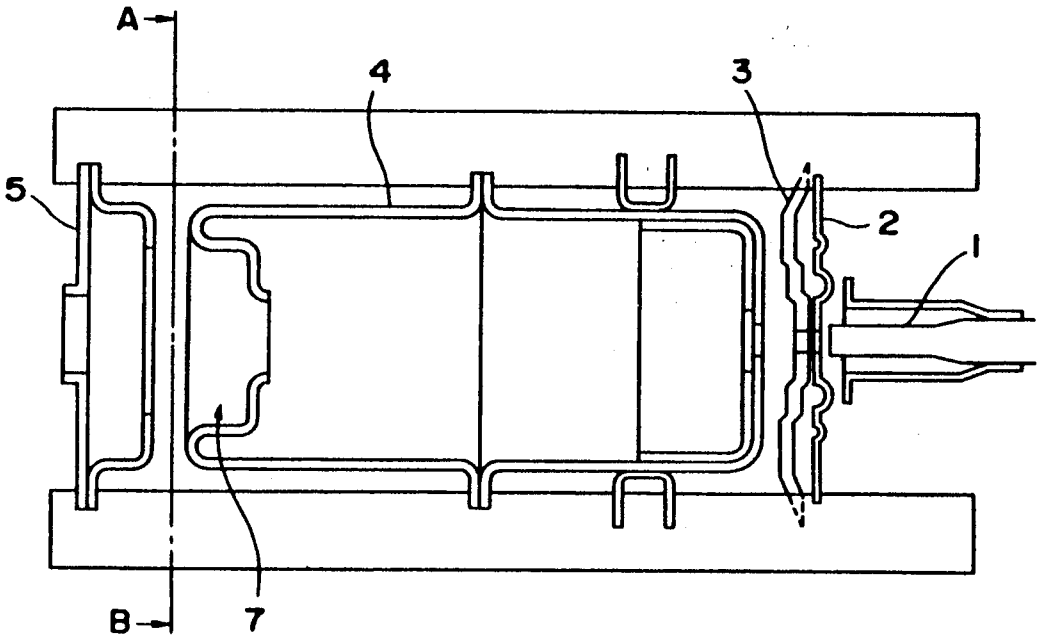
Fig. 1(a) Prior Art
FIG. 1 (*a*) is a side section showing the structure of a conventional in-line type electron gun.
Figure 1B:
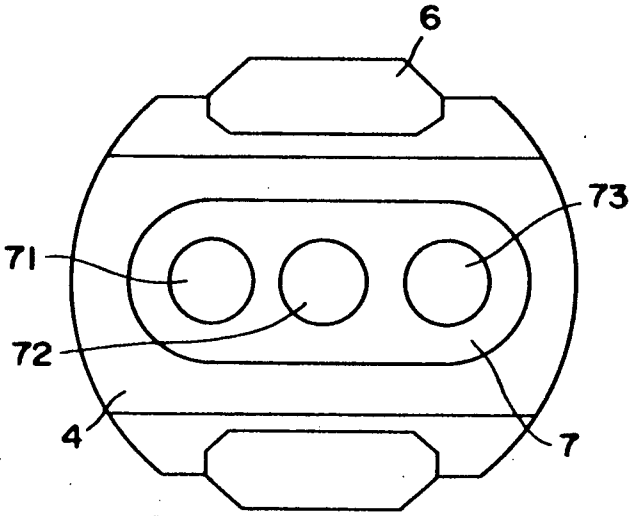
Fig. 1(b) Prior Art
Figure 2A:
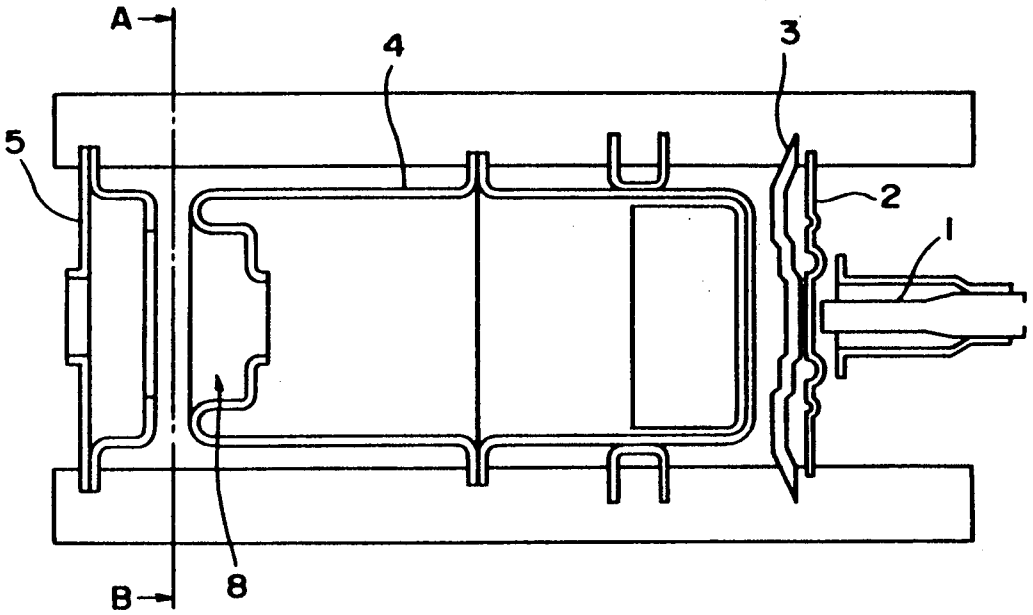
FIG. 2 (*a*) is a side section showing the structure of an in-line type electron gun of a first invention.
Figure 2B:
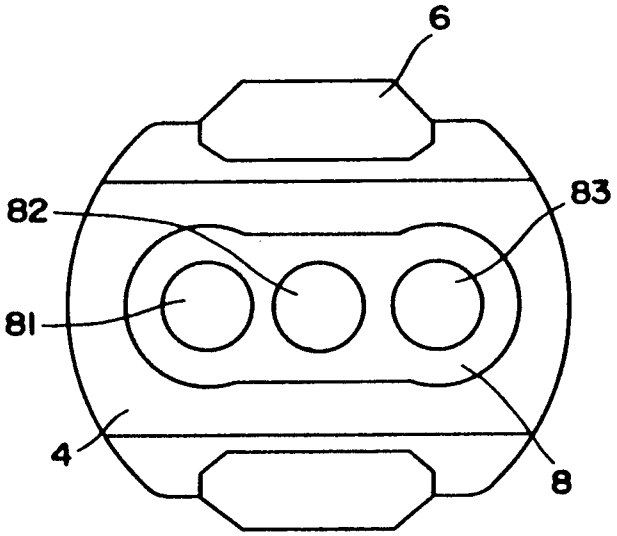

FIG. 2 shows the structure of an in-line type electron gun of a first invention, in its side section (a), and front section (b) by line A–B thereof. The parts identical with or corresponding to those shown in the conventional example in FIG. 1 are given same reference numbers.

In the figure, numeral 1 is a cathode, 2 is a number 1 grid (G1 grid) disposed before the cathode 1, 3 is a number 2 grid (G2 grid) disposed before the G1 grid, 2, 4 is a number 3 grid (G3 grid) disposed before the G2 grid 3, and 5 is a number 4 grid (G4 grid) disposed before the G3 grid 4.

A triode is composed by G1 grid 2 and G2 grid 3. A main focusing lens is formed by the G3 grid 4 and G4 grid 5 between them (at the position of line A–B in the drawing), in which the G3 grid 4 is a lower voltage side grid. Numeral 6 is a beed glass for fixing the grids 2, 3, 4, 5. Numeral 8 is a depression formed in the front face of the G3 grid 4, or more specifically, in the plane facing the opposing gap to the G4 grid 5. When a voltage is applied between the G3 grid 4 and G4 grid 5, a magnetic field is generated, and a main focusing lens common to three electron beams is formed in the depression 8. At the bottom of the depression 8, there are three lens holes 81, 82, 83 identical in diameter in-line for forming small lenses for individual electron beams corresponding to the red, green and blue colors.

In such in-line type electron gun of this invention, the thermion generated by the cathode 1 is pulled out and accelerated by the voltage applied to the G1 grid 2 and G2 grid 3 which make up the triode. And the electric field caused by the difference in the voltage applied to the G3 grid 4 and G4 grid 5 (as mentioned above, the G3 grid 4 is at the lower voltage) forms a main focusing lens in the depression 8, which causes to warp the orbit of the electron, so that the three electron beams are converged and focused at one point at the position in front of the G4 grid 5.

The above structure is basically the same as the conventional structure described earlier, but in the prior art, the depression 7 in the front face of the G3 grid 4 is made in an oval form, or more practically a race track form oblong in the lens hole array direction, while in the electron gun of this invention, the depression 8 in the front face of the G3 grid 4 is narrowed in the width perpendicular to the lens hole array direction, at the portion of the center lens hole 82 as shown in FIG. 2 (*b*), being minimum in the middle.

In the in-line type electron gun of this invention, the curvature of the equipotential surface of magnetic field in the vertical direction is greater in the center lens hole 82 portion, than in the both outer lens hole 81, 83 portions. Accordingly, the converging power is great in the direction perpendicular to the lens holes array direction with respect to the center electron beam by the center lens hole 82, and the focus voltage in the direction perpendicular to the lens hole array direction applied to the middle electron beam can be raised.

The difference of such focus voltage of the center electron beam from the prior art is as follows: since the focus voltage of both outer electron beams is not influenced largely, the difference in the focus characteristic between the middle electron beams and the outer electron beams as experienced in the conventional electron gun is corrected, so that the focus voltage may be extremely uniformed. It also means that the spot shapes of the three electron beams may be obtained nearly in an identical form.

Figure 3:
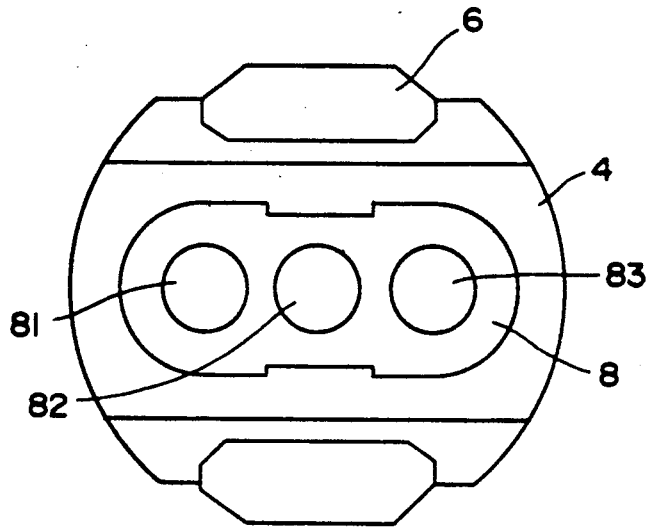
FIGS. 3, 4 are front sections of different embodiments thereof.
Figure 4:
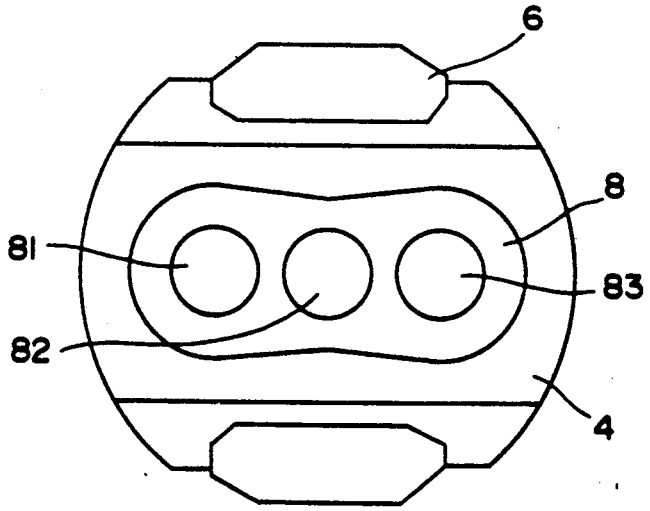

FIGS. 3 and 4 are other embodiments of the in-line type electron gun of said first invention, showing the front section in the same position as in FIG. 2 (*b*). In FIG. 3, the width in the direction perpendicular to the lens hole array direction in the depression 8 is narrowed by the notch parallel to the lens hole array direction along a specified length in the center lens hole 82 portion. Therefore, the portion of the minimum width continues along the specified length, around the central position of the center lens hole 82. In FIG. 4, similarly, a triangular notch is provided. Therefore, the width is minimum at the central position of the center lens hole 82. In either embodiment, the width in the direction perpendicular to the lens hole array direction in the depression 8 is minimum in the central position of the center lens hole 82. Accordingly, in either embodiment, the same effect as shown in FIG. 2 is exhibited.

Figure 5A:
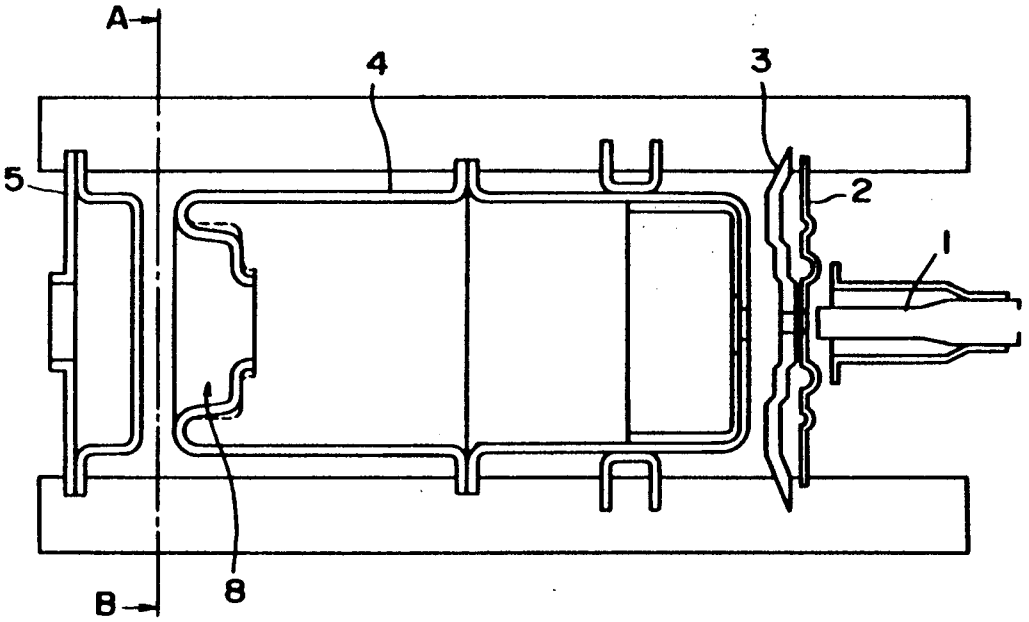
FIG. 5(*a*) is a side section showing the structure of an in-line type electron gun of a second invention.
Figure 5B:
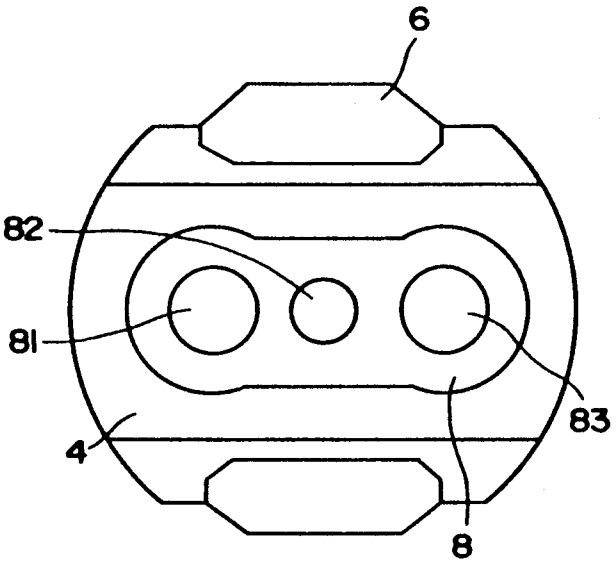

Referring now to FIG. 5, a second invention is explained hereunder. In the above in-line type electron gun of the first invention, the focus voltage in the lens array direction with respect to the electron beam from the center lens hole 82 tends to be lower somewhat. Hence, the second invention is intended to present an in-line type electron gun of higher performance by eliminating this tendency completely.

The in-line type electron gun of the second invention is identical in structure with that of the first invention, except that the center lens hole 82 of the three lens holes 81, 82, 83 formed at the bottom of the depression 8 is smaller in diameter than the two outer lens holes 81, 83.

The in-line type electron gun of the second invention in such structure can correct the lowering of focus voltage in the lens array direction with respect to the center electron beam from the middle lens hole 82.

Therefore, in the in-line type electron gun of the second invention shown in FIG. 5, in addition to the improvement of focus voltage in the direction perpendicular to the lens hole array direction of the center electron beam in the first invention, lowering of the focus voltage in the lens hole array direction can be corrected. As a result, in the second invention, the focus voltages of the three electron beams can be unified more completely, so that the shape of beam spots of the three electron beams may be completely identical.

Figure 6:
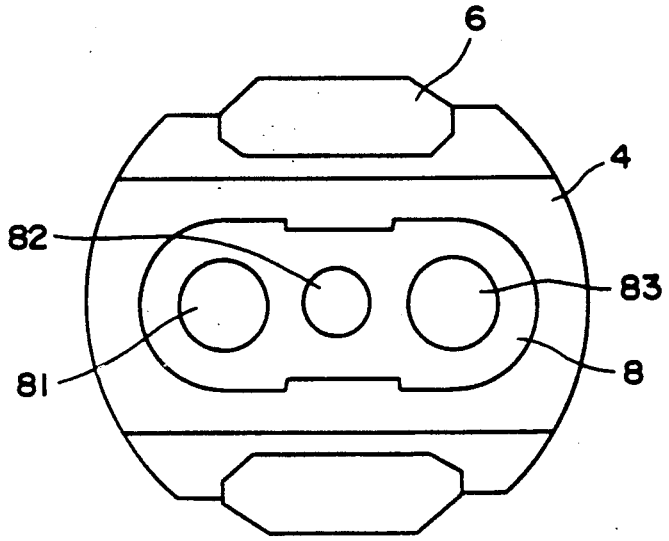
FIGS. 6, 7 are front section of different embodiments thereof.
Figure 7:
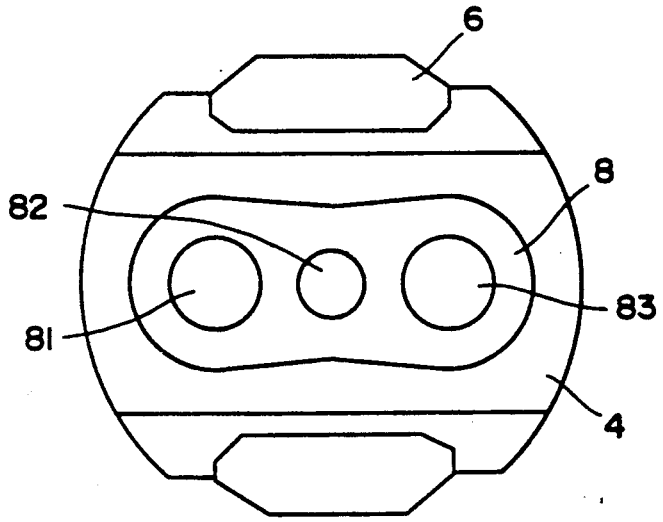

FIGS. 6 and 7 shown other embodiments of the second invention, corresponding to the different embodiments of the first invention shown in FIGS. 3 and 4.

Thus, in the in-line type electron gun of this invention, since the focus voltages and beam spot shapes of the three electron beams corresponding to the red, green and blue colors can be unified extremely, fabrication of super-high resolution CRT may be realized.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within the meets and bounds of the claims, or equivalence of such meets and bounds thereof are therefore intended to be embraced by the claims.

What is claimed is:

1. An in-line type electron gun having a lower voltage electrode disposed in spaced opposition to a higher voltage electrode, said electrodes forming a main focusing lens, the lower voltage electrode having a depression, and three lens holes in the bottom of said depression, the lens holes having centers which are colinear in an array direction for passing electron beams therethrough, wherein the middle lens hole of said three lens holes has a diameter smaller than the diameters of the other two lens holes, and a width of said depression in a crosswise direction perpendicular to the array direction is smaller at a central part of the depression as compared with widths in the crosswise direction of other parts of the depression, the central part of the depression being between the centers of the other two lens holes.

2. An in-line type electron gun as set forth in claim 1, wherein said width of said central part of said depression is a minimum for a predetermined length of the depression in a direction parallel to the array direction.

3. An in-line type electron gun as set forth in claim 1, wherein said width of said central part of said depression is a minimum at the center of the middle lens hole.

* * * * *